US009735525B2

(12) United States Patent
Liao

(10) Patent No.: US 9,735,525 B2
(45) **Date of Patent: *Aug. 15, 2017**

(54) MULTIFUNCTIONAL CONNECTING DEVICE

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/379,773

(22) Filed: Dec. 15, 2016

(65) Prior Publication Data

US 2017/0098914 A1 Apr. 6, 2017

Related U.S. Application Data

(63) Continuation-in-part of application No. 14/814,985, filed on Jul. 31, 2015, now abandoned.

(30) Foreign Application Priority Data

Jun. 10, 2015 (TW) ..... 104118819 A

(51) Int. Cl.
*H01R 27/00* (2006.01)
*H01R 24/60* (2011.01)
*H01R 107/00* (2006.01)

(52) U.S. Cl.
CPC ..... *H01R 27/00* (2013.01); *H01R 24/60* (2013.01); *H01R 2107/00* (2013.01)

(58) Field of Classification Search
CPC ..... H01R 13/518; H01R 13/4538
USPC ..... 439/131, 540.1
See application file for complete search history.

(56) References Cited

U.S. PATENT DOCUMENTS 7,815,447 B1 * 10/2010 Chiang ..... H01R 13/6658 439/131
8,029,303 B2 * 10/2011 Chiang ..... H01R 13/60 439/131
8,348,685 B2 * 1/2013 Liao ..... H01R 27/02 439/131
8,465,304 B2 * 6/2013 Yen ..... H01R 13/4538 439/131
2008/0050975 A1 * 2/2008 Liao ..... H01R 13/62 439/660
2009/0137137 A1 * 5/2009 Jeong ..... H01R 29/00 439/131
2011/0269335 A1 * 11/2011 Zhang ..... H01R 13/4538 439/502

(Continued)

*Primary Examiner* — Tulsidas C Patel
*Assistant Examiner* — Marcus Harcum
(74) *Attorney, Agent, or Firm* — Li & Cai Intellectual Property (USA) Office

(57) ABSTRACT

A multifunctional connecting device includes a first module, a second module and a housing. The first module has a first insulating main body and a first terminal set. The first terminal set has a plurality of first and second terminals. The first terminals are formed with a first contact portion and a first conductive portion. The second terminals are formed with a second contact portion and a second conductive portion. The second module has a second insulating main body and a second terminal set. The second terminal set has a plurality of third and fourth terminals. The first module and the second module are arranged in a stacked manner. When the first module is moved to a first position, the first module is launched to the use stage accordingly.

13 Claims, 19 Drawing Sheets

(56) References Cited

U.S. PATENT DOCUMENTS

2014/0057495 A1* 2/2014 Liao ..... H01R 13/4538
439/660

* cited by examiner

MULTIFUNCTIONAL CONNECTING DEVICE

CROSS-REFERENCE TO RELATED APPLICATIONS

This application is a Continuation-in-Part of application Ser. No. 14/814,985 filed Jul. 31, 2015, and entitled multifunctional connecting device.

BACKGROUND OF THE INVENTION

1. Field of the Invention

The present invention is related to a connector, in particular, the present invention relates to a retractable multifunctional connecting device.

2. Description of Related Art

Universal Serial BUS, USB, is widely used in a great variety of communication products nowadays. At least one or more USB connectors can be seen on a single communication product. Mini USB connectors and Micro USB connectors having smaller dimensions therefore are usually being utilized in portable devices.

However, the conventional connectors have only one type of USB module thereon. In other words, a USB connector is only compatible to any one of the following standards: USB Type-A, USB Type-B, Mini USB, Micro USB and the like. The USB connector is exclusive to one type of USB module resulting in limited application.

Therefore, it is desirable to propose a novel connecting device to overcome the above-mentioned problems.

SUMMARY OF THE INVENTION

The object of the instant disclosure is to provide a multifunctional connecting device and a retractable connector compatible to different types of plugs thus supporting broader applications.

According to one exemplary embodiment of the present invention, a multifunctional connecting device comprises a first module. The first module includes a first insulating main body and a first terminal set disposed in the first insulating main body. The first terminal set has a plurality of first terminals and a plurality of second terminals, each of the first terminals is formed with a first contact portion and a first conductive portion. Likewise, each of the second terminals is formed with a second contact portion and second conductive portion. A second module includes a second insulating main body and a second terminal set, the second terminal set is disposed in the second insulating main body and has a plurality of third terminals and a plurality of fourth terminals. Each of the third terminals is formed with a third contact portion, a third conductive portion and a first connecting portion, likewise, each of the fourth terminals is formed with a fourth contact portion, a fourth conductive portion and a second connecting portion. The first module stacks on the second module and the first module, the first module configures to move toward a first position hence the third conductive portion and the fourth conductive portion contacts the corresponding first conductive portion and the second conductive portion respectively, as a result, the first module is launched to a use stage. The first module configures to move toward a second position where the third conductive portion and the fourth conductive portion detaches from the corresponding the first conductive portion and the second conductive portion, as a result, the first module launches to a retracted stage and the second module launches to an use stage. A housing envelopes the exterior of the first module comprising a hole, and two protrusions are formed in the opposite sides of the hole respectively resulting to secure the second module.

The present invention also provides another multifunctional connecting device, which comprises a first module and a second module. The first module includes a first insulating main body and a first terminal set. The first terminal set disposes in the first insulating main body and has a plurality of first terminals, each of the first terminals is formed with a first contact portion and a first conductive portion. The second module includes a second insulating main body and a second terminal set. The second terminal set is disposed in the second insulating main body and has a plurality of third terminals, each of the third terminals is formed with a third contact portion, a third conductive portion and a first connecting portion. The first module stacked on the second module, the first module configures to move toward a first position where the third conductive portion contacts with the corresponding first conductive portion, and as a result, the first module launches to a use stage. The first module is configured to move toward a second position where the third conductive portion detaches from the corresponding first conductive portion, and as a result, the first module launches to a retracted stage and the second module launches to a use stage. A housing envelopes the exterior of the first module, the housing comprises a hole and two protrusions formed in the opposite side of the hole respectively, resulting to secure the second module.

The present invention further provides another multifunctional connecting device, which comprises a first module and a second module. The first module includes a first insulating main body and a first terminal set, the first terminal set is disposed in the first insulating main body and has a plurality of first terminals and a plurality of second terminals, each of the first terminals is formed with a first contact portion and a first conductive portion, likewise each of the second terminal is formed with a second contact portion and second conductive portion. The second module includes a second insulating main body and a second terminal set, the second terminal set disposes in the second insulating main body and has a plurality of third terminals and a plurality of fourth terminals, each of the third terminals is formed with a third contact portion, a third conductive portion and a first connecting portion, likewise each of the fourth terminals is formed with a fourth contact portion, a fourth conductive portion and a second connecting portion. The first module stacked on the second module, and the first module is configured to move toward a first position where the third conductive portion and the fourth conductive portion contacts with the corresponding first conductive portion and the second conductive portion, and as a result, the first module is launched to a use stage. The first module is configured to move toward a second position where the third conductive portion and the fourth conductive portion detaches from the corresponding first conductive portion and the second conductive portion, and as a result, the first module launches to a retracted stage and the second module launches to a use stage.

The present invention further provides another multifunctional connecting device, which comprises a first module and a second module. The first module includes a first insulating main body and a first terminal set, The first terminal set is disposed in the first insulating main body and has a plurality of first terminals, each of the first terminals is formed with a first contact portion and a first conductive portion. The second module includes a second insulating main body and a second terminal set. The second terminal set is disposed in the second insulating main body and has a plurality of third terminals, likewise each of the third terminals is formed with a third contact portion, a third conductive portion and a first connecting portion. The first module stacks on the second module and the first module is configured to move toward a first position hence the third conductive portion contacts the corresponding first conductive portion and as a result the first module launches to use stage. The first module is configured to move toward a second position where the third conductive portion detaches from the corresponding first conductive portion, and as a result, the first module launches to a retracted stage and the second module launches to use stage.

The present invention also provides another multifunctional connecting device meets a USB Type-C specification, which comprises a second insulating main body and a second terminal set. The second terminal set disposes in the second insulating main body and has a plurality of third terminals and a plurality of fourth terminals, each of the third terminals is formed with a third contact portion, third conductive portion and a first connecting portion, likewise each of the fourth terminals is formed with a fourth contact portion, fourth conductive portion, and a second connecting portion. The third conductive portion and the fourth conductive portion are exposed to one side or both sides of the second insulating main body.

The present invention may have one or more of the following advantages: The aforementioned multifunctional connecting device is retractable, the first module is linearly movable on the second module and compatible to different types of plugs, the user could operate through the first module or the second module thus supporting broader applications and the multifunctional connecting device is easy to use.

In addition, the multifunctional connecting device has a housing which has a hole and protrusions, the protrusions are configured to allow the second module to be disposed steadily in the first module and forwardly and backwardly movable on the first module thus the first module is electrically contactable to the second module.

The second module is rotatably and extendable, in addition, it adapts to connect to other type plugs thus supporting broader applications and the multifunctional connecting device is easy to use.

The multifunctional connecting device has two first modules; each of the first modules is disposed in the top and bottom side of the second module respectively. The user could operate two first modules or the second modules according to requirements.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

Figure 1:
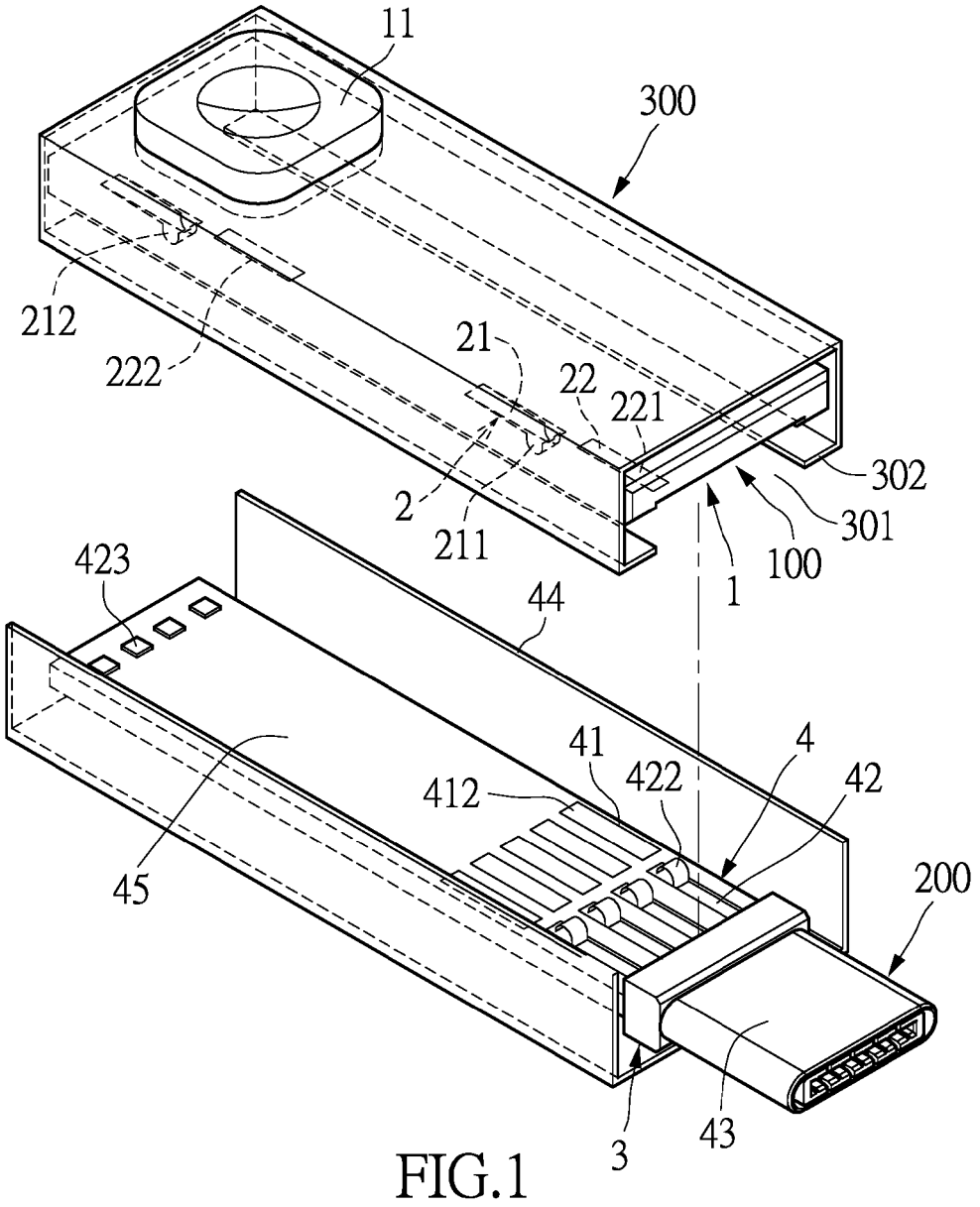
FIG. 1 illustrates an exploded view of a multifunctional connecting device in accordance with a first embodiment of the instant disclosure.
Figure 2:
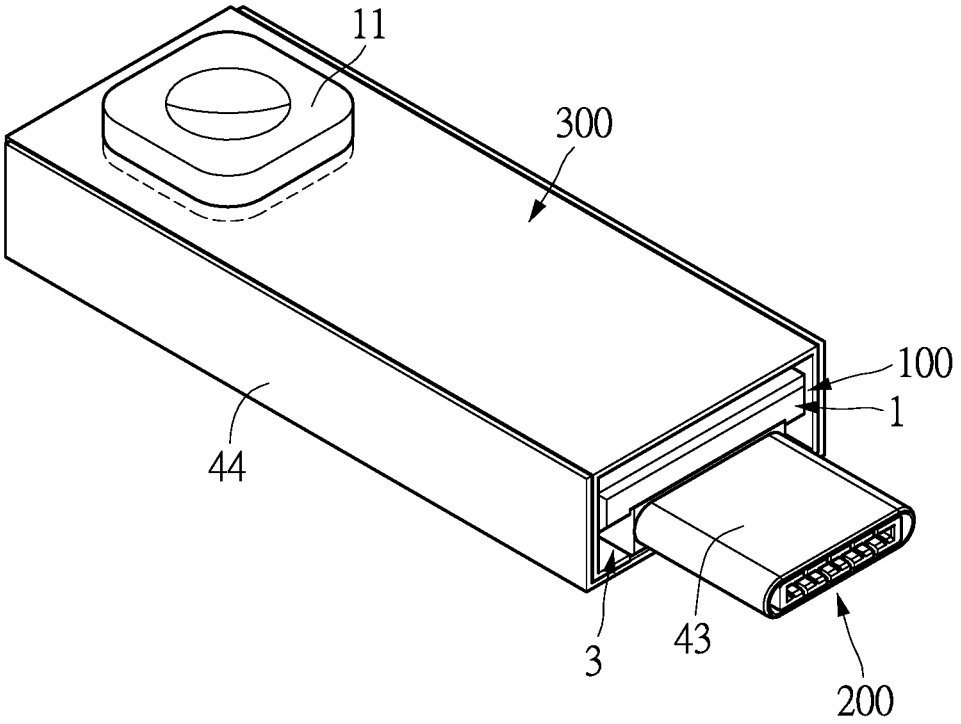
FIG. 2 illustrates a perspective view of a multifunctional connecting device in accordance with a first embodiment of the instant disclosure.
Figure 3:
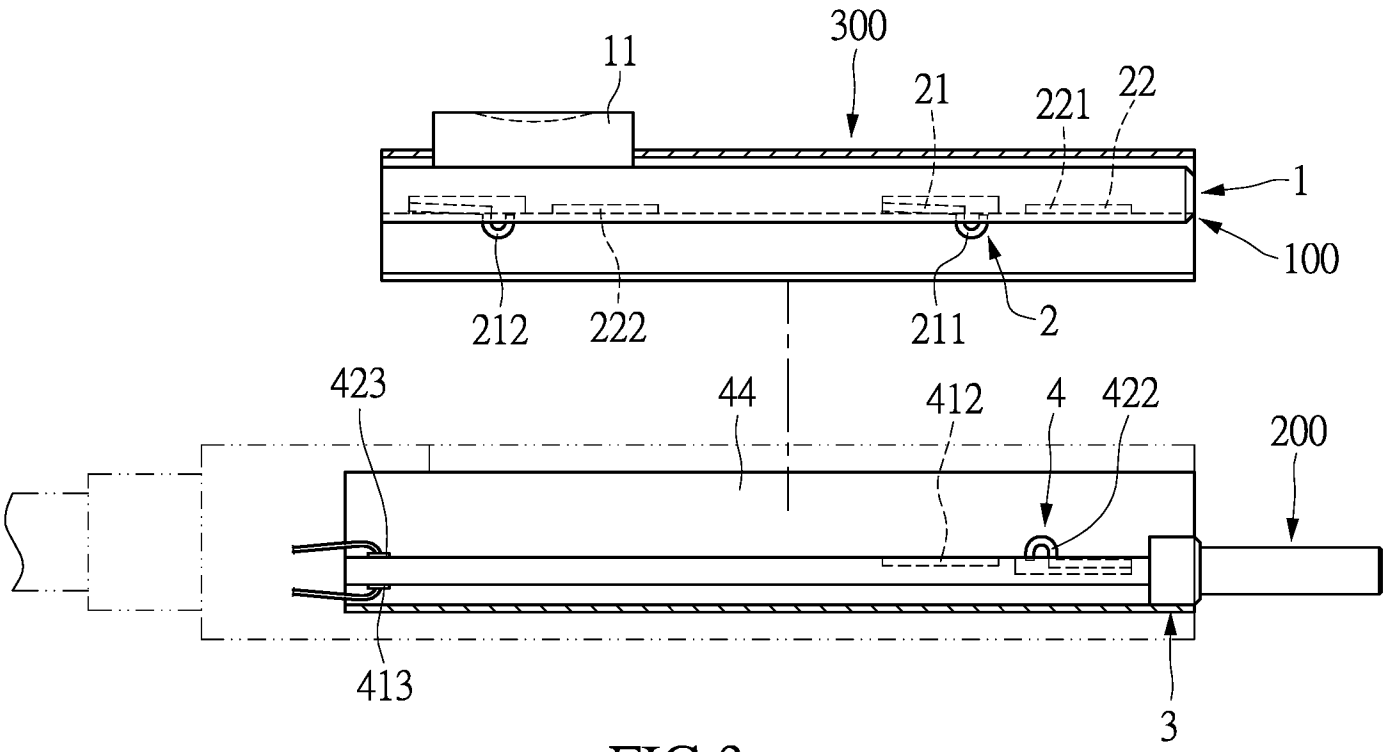
FIG. 3 illustrates the cross section view of a multifunctional connecting device in accordance with a first embodiment of the instant disclosure.
Figure 4:
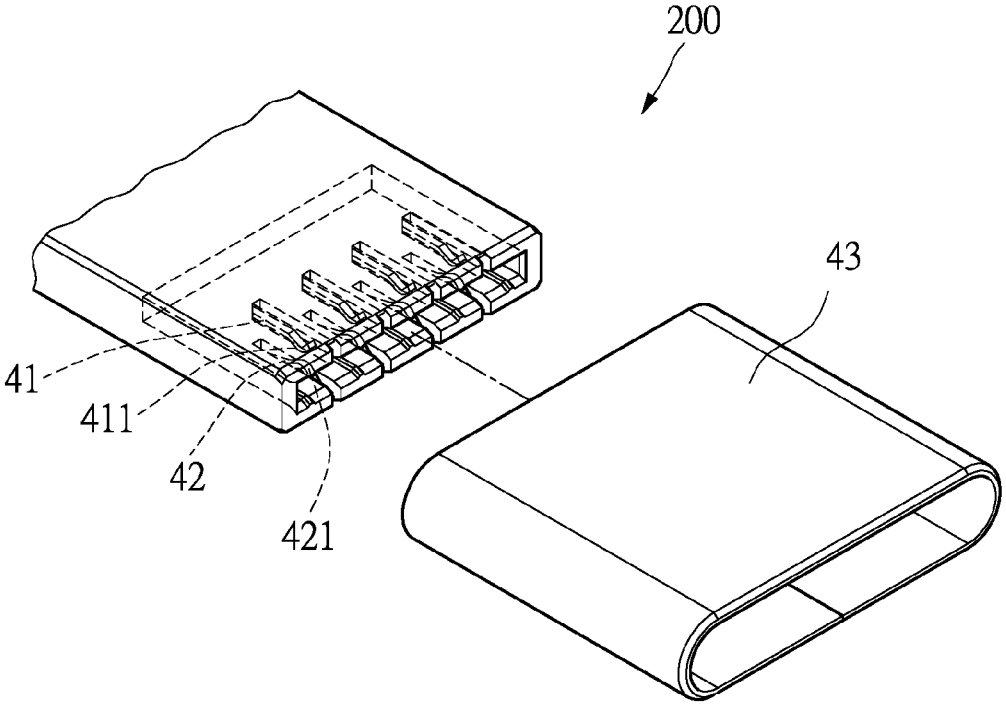
FIG. 4 illustrates an exploded view of a second module of a multifunctional connecting device in accordance with a first embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings.

First Embodiment

With reference to FIG. 1~4 the instant disclosure provides a multifunctional connecting device, which comprises a first module 100, a second module 200 and a housing 300. In the first embodiment, the first module 100 meets the USB 3.0 Type-A specification, whereas the second module 200 meets the USB Type-C specification. However, the specification of the first modules 100, 200 can be any one of the following standards: USB Type-A, USB Type-B, Micro USB, Mini USB. In addition, USB 3.0 and USB 2.0 are also adaptable to the first and second modules 100, 200. The first and second modules 100, 200 are interchangeable between receptacles and plugs.

The first module 100 includes a first insulating main body 1 and a first terminal set 2, the first terminal set 2 is disposed in the first insulating main body 1. The first terminal set 2 has a plurality of terminals 21, 22. In the first embodiment, the first terminal set 2 has a plurality of first terminals 21 and a plurality of second terminals 22, the first terminals 21 are arranged on the first insulating main body 1, the second terminals 22 are arranged on the first insulating main body 1 as well and working with the first terminals 21 to execute the USB 3.0 communication protocol.

The head of the first and the second terminals 21, 22 are formed with a first contact portion 211 and a second contact portion 221 respectively. The first and second contact portions 211, 221 are exposed to the one side of the first insulating main body 1 and adapted to electrically connect to the terminals of a corresponding electronic device. The tails of first and second terminals 21, 22 are formed with a plurality of a first conductive portion and a plurality of a second conductive portion 212, 222. The first and second conductive portion 212, 222 are exposed to one side of the first insulating main body 1 for electrically connecting to the terminals of the second module 200.

The second module 200 includes a second insulating main body 3, and a second terminal set 4 which is disposed in the second insulating main body 3. The second insulating main body 3 is a flattened plate. The second terminal set 4 has a plurality of terminals 41, 42. In the first embodiment, the second terminal set 4 has a plurality of third terminals 41 and a plurality of fourth terminals 42. The third terminals 41 and the fourth terminals 42 are arranged on the second insulating main body 3 to execute the USB Type-C communication protocol.

The third and fourth terminals 41, 42 are formed with a third contact portion 411 and a fourth contact portion 421 respectively at the front end thereof. The third and fourth contact portion 411, 421 are respectively exposed to the top and bottom side of the interior from the second insulating main body 3 for electrically connecting an electronic product. In the center part of the third and fourth terminals 41, 42, a third and fourth conductive portion 412, 422 are formed thereof. The third and fourth conductive portion 412, 422 are exposed to one side of the second insulating main body 3 to selectively contact the first and second conductive portion 212, 222, and the second terminal set 4 are electrically connected the first terminal set 2. The second insulating main body 3 and the second terminal set 4 may further be enveloped by a metallic shell 43.

The third conductive portion 412 of the third terminals 41 and the fourth conductive portion 422 of the fourth terminals 42 are formed on a circuit board 45 as well. The rear end of the second insulating main body 3 comprises a containing seat 44 with a U-shape which is made by plastics or metal. The containing seat 44 is fabricated on the second insulating main body 3 as one whole body or arranged on the second insulating main body 3, so as the first module 100 and housing 300 are installed inside the containing seat 44, the first module 100 is stationary, moveable along the second module 200 correspondingly.

The first and second connecting portion 413, 423 are formed on the tails of the third and fourth terminals 41, 42 respectively, the first and second connecting portion 413, 423 are configured to weld to the cables, circuit board or electrically connected to another electric device, however, the manner of connecting is variable and not restricted thereto. In the first embodiment, the first connecting portion 413 and the second connecting portion 423 are formed on the circuit board 45. The first connecting portion 413 and the second connecting portion 423 are electrically connected to the corresponding connector and form a contacting structure (e.g. spring, welding, etc.).

In the first embodiment, the first terminal set 2 comprises a plurality of the first terminals 21 and a plurality of the second terminals 22, the second terminal set 4 comprises a plurality of the third terminals 41 and a plurality of the fourth terminals 42, however the number and the layout of the terminals are not restricted thereto. For instance, the first terminal set 2 includes a plurality of the first terminals 21, the second terminal set 4 includes a plurality of the third terminals 41, the aforementioned contact portion, the conductive portion and the connecting portion arranged in one, two, or multiple rows.

The first module 100 is stacked on the second module 200, that is to say, the first module 100 overlaps the second module 200 so the first module 100 is forwardly and backwardly movable along the second module 200, and the first module 100 is movable to a first position (the front end) or a second position (the back end). In the first embodiment, the second module 200 may further be fabricated on the housing 400 as one whole body or arranged on the housing 400, as shown in FIG. 5.

Figure 5:
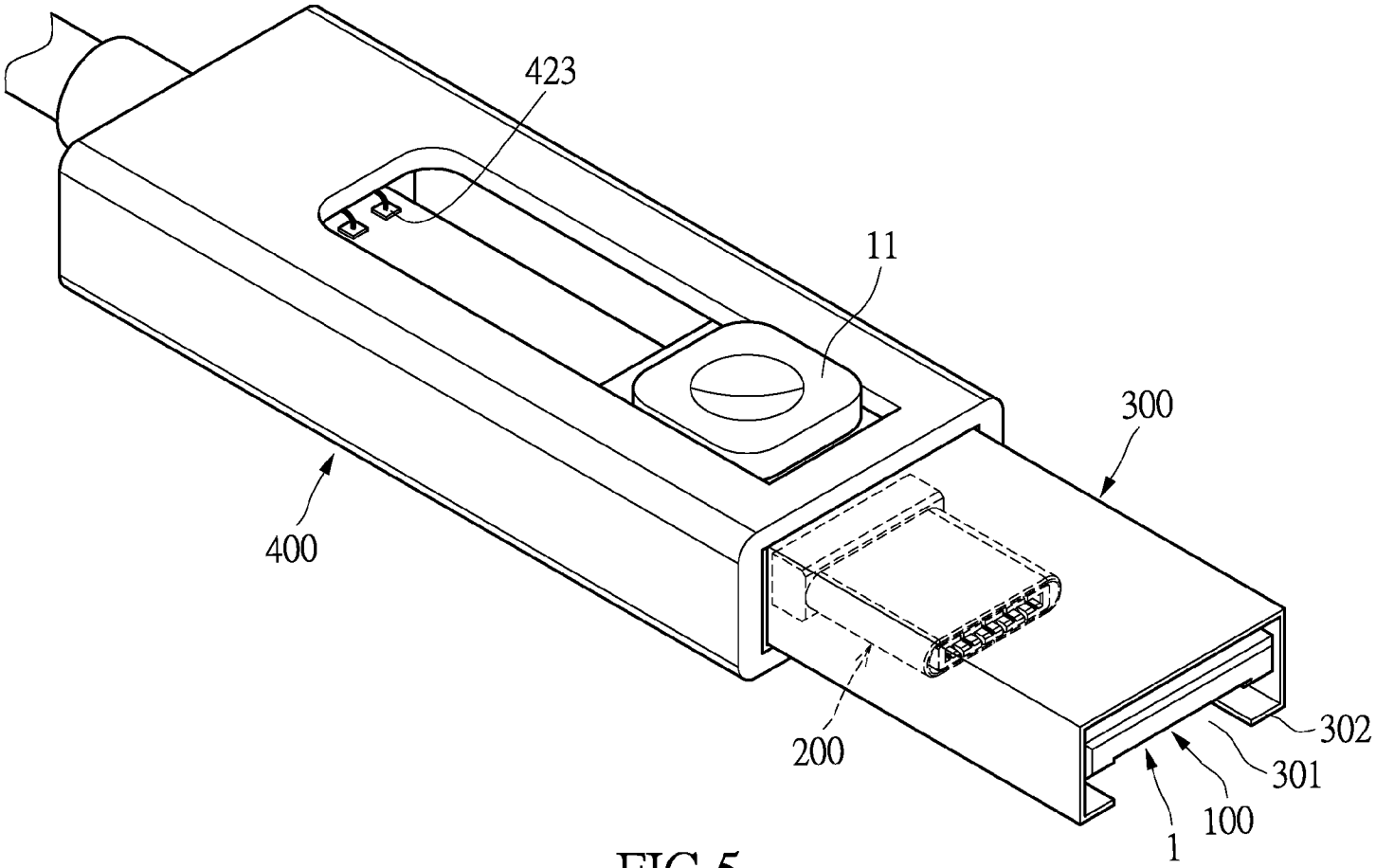
FIG. 5 illustrates a schematic diagram of a multifunctional connecting device in accordance with a first embodiment of the instant disclosure.
Figure 6:
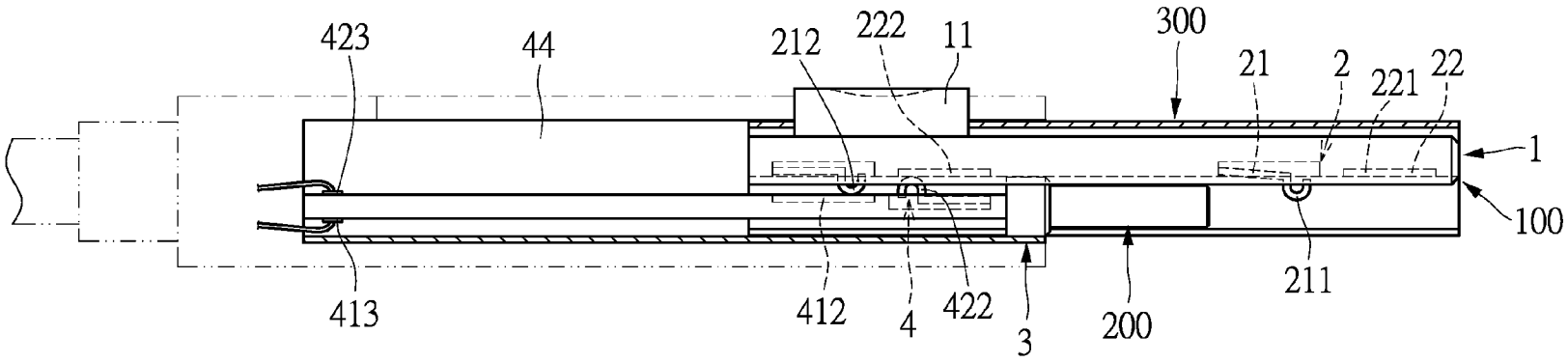
FIG. 6 illustrates the edge view of a multifunctional connecting device in accordance with a first embodiment of the instant disclosure.

As shown in FIGS. 5 and 6, when the first module 100 moves toward the first position, the first module 100 launches to a use stage, the third conductive portion 412 and the fourth conductive portion 422 contact with the corresponding first conductive portion 212 and the second conductive portion 222 respectively resulting in electrical connection between the first terminal set 2 and the second terminal set 4. That is to say, the first terminal set 2 receives power or signals from the associated cables or circuit board connecting to the second terminal set 4 and therefore the first module 100 is live as well, the first contact portion 211 of the first module 100 and the second contact portion 221 are electrically connected an electronic product. In addition, the housing 400 can act as a limiter to limit the linear sliding movement of the first module 100, so that when the first module 100 moves toward the first position, the first module 100 can be better positioned to prevent sliding out.

Figure 7:
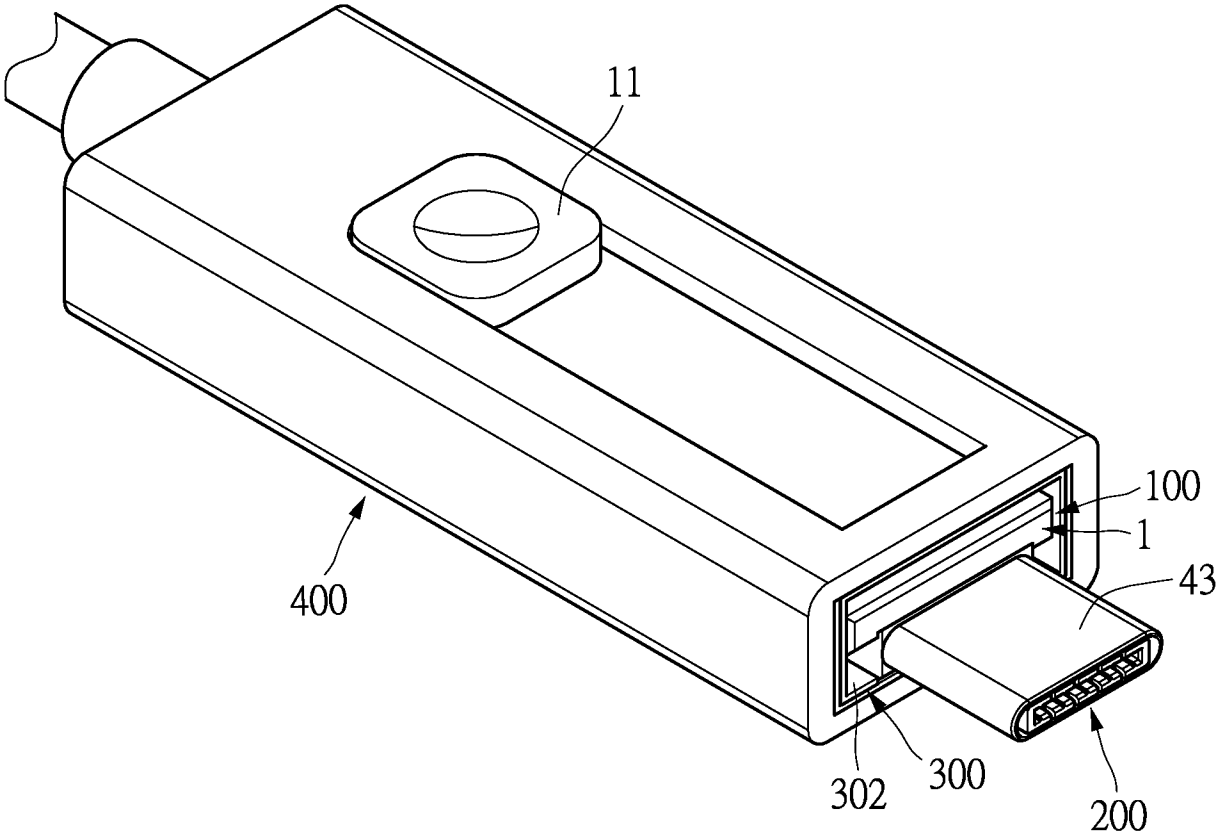
FIG. 7 illustrates another schematic diagram of a multifunctional connecting device in accordance with a first embodiment of the instant disclosure.
Figure 8:
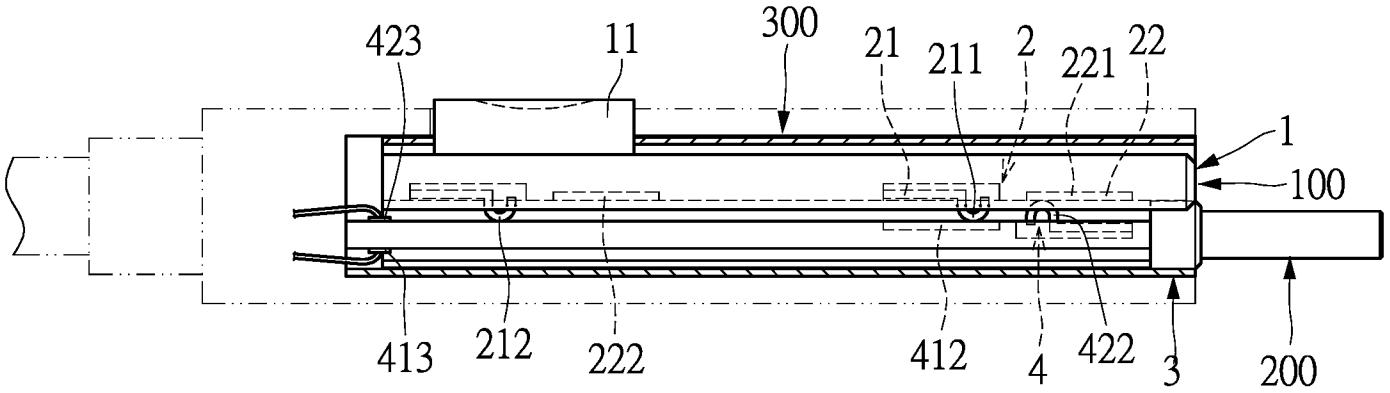
FIG. 8 illustrates the edge view of another schematic diagram of a multifunctional connecting device in accordance with a first embodiment of the instant disclosure.

Furthermore, as shown in FIGS. 7 and 8, when the first module 100 moves backward toward the second position, the first module 100 launches to a retracted stage and the second module 200 launches to a use stage, the third conductive portion 412 and the fourth conductive portion 422 are detached from the corresponding first conductive portion 212 and the second conductive portion 222, hence the third contact portion 411 and the fourth contact portion 421 are available to electrically connect to the corresponding an electronic product. Therefore, the first module 100 is linearly movable along the second module 200 and the multifunctional connecting device is retractable and free to operate by the first module 100 or the second module 200.

Moreover, in another preferred embodiment, the first terminal set 2 may simply include a plurality of the first terminals 21, the second terminal set 4 simply includes a plurality of the third terminals 41, when the first and second module 100, 200 are moved forwardly and backwardly, the multifunctional connecting device is retractable and available to switch to the first module 100 or the second module 200 for two different operations. In other words, when the first module 100 moves toward the first position, the first module 100 launches to use stage, the third conductive portion 412 contacts with the corresponding the first conductive portion 212. On the contrary, when the first module 100 moves toward the second position, the first module 100 launches to a retracted stage and the second module 200 launches to a use stage, the third conductive portion 412 detaches from the corresponding first conductive portion. Furthermore, when the first and second module 100, 200 move to the predetermined position, they can be positioned by bumps, detents and the like, the way of engagement between the first and second modules 100, 200 is not restricted.

A housing 300 envelopes the exterior of the first module 100, namely the housing 300 also envelopes the first insulating main body 1 and the like. The housing 300 could be made by metal for instance, the front end of the housing 300 is formed with an opening, one side of the housing 300 comprises a hole 301, and the hole 301 extends to both ends of the housing 300. Two protrusions 302 are formed in the opposite sides of the hole 301 respectively, the protrusions 302 extend internally from the bottom side both sides of the housing 300, and the protrusions 302 may be arranged horizontally and parallel to one another. The second module 200 may be enveloped by the housing 300, the second module 200 is positioned by two protrusions 302 so the first module 100 is steadily moveable along the second module 200. Furthermore, the first module 100 may further include a slide button 11 which is disposed on the top or bottom side face of the first insulating main body 1. In the first embodiment, the slide button 11 projects out from the top face of the first insulating main body 3 and facilitates the linear sliding of the first module 100.

Second Embodiment

Figure 9:
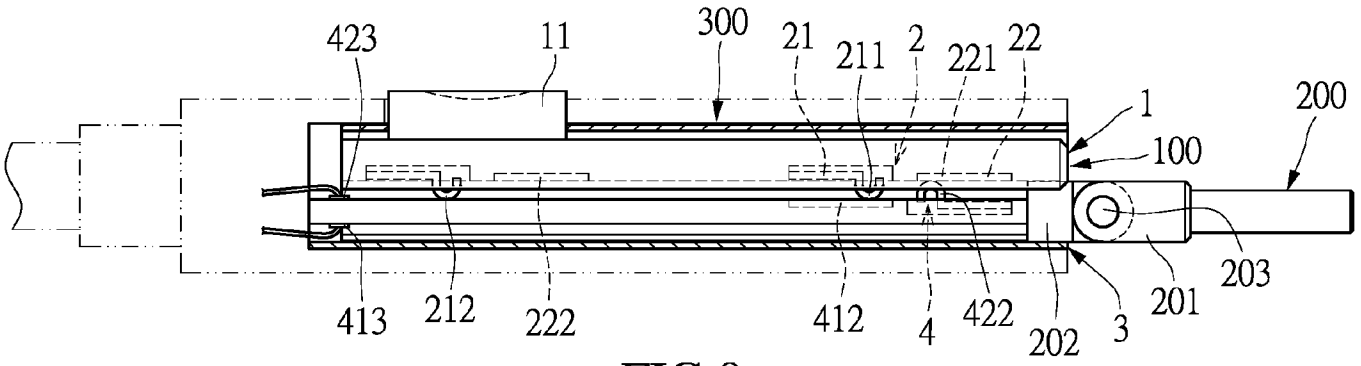
FIG. 9 illustrates the edge view of a multifunctional connecting device in accordance with a second embodiment of the instant disclosure.
Figure 10:
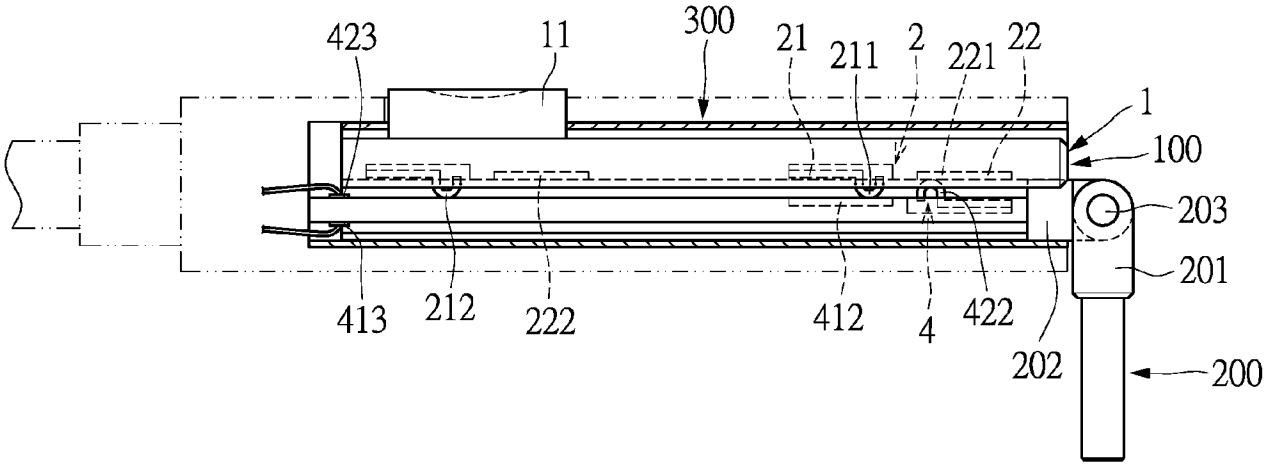
FIG. 10 illustrates the edge view of another schematic diagram of a multifunctional connecting device in accordance with a second embodiment of the instant disclosure.

With reference to FIGS. 9 and 10, in the second embodiment, the front section of the second module 200 is rotatable, that is, the second module 200 can be split into two parts, a second front section 201 and a second rear section 202. The second front section 201 is pivoted on the second rear section 202 by a second shaft assembly 203. The second shaft assembly 203 allows upward or downward rotation of the second module 200. The third terminals 41 of the second front section 201 and the fourth terminals 42 of the second rear section 202 are split into two parts (not shown) and re-connect by wires, conductive plates or soft circuit printed board.

Third Embodiment

Figure 11:
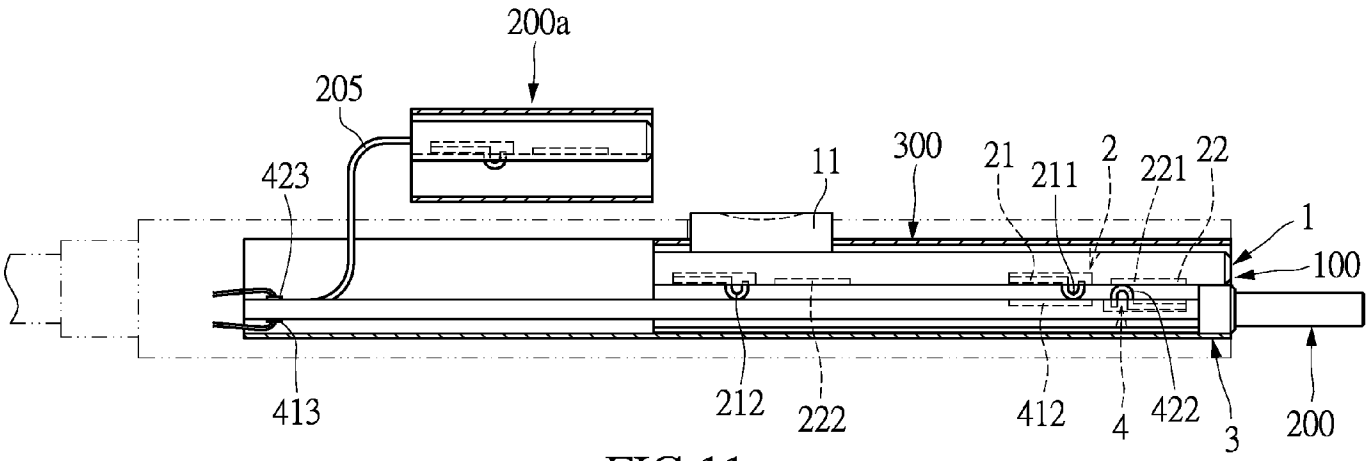
FIG. 11 illustrates the edge view of a multifunctional connecting device in accordance with a third embodiment of the instant disclosure.

With reference to FIG. 11, the third embodiment further comprises a third module **200*a* which electrically connects to a second terminal set of the second module 200 by a connecting line 205. The connecting line 205 is flexible and facilitates the third module 200*a* disposed in the second module 200** in a linearly moveable manner.

Fourth Embodiment

Figure 12:
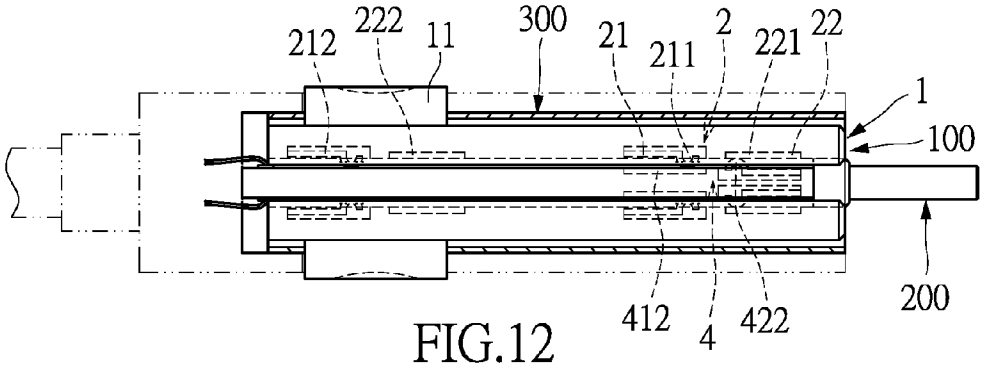
FIG. 12 illustrates the edge view of a multifunctional connecting device in accordance with a fourth embodiment of the instant disclosure.

With reference to FIG. 12, in the fourth embodiment, two first modules 100 are forwardly and backwardly movable on the second module 200 so the multifunctional connecting device is retractable and free to be operated by the two first modules 100 or the second module 200.

Fifth Embodiment

Figure 13:
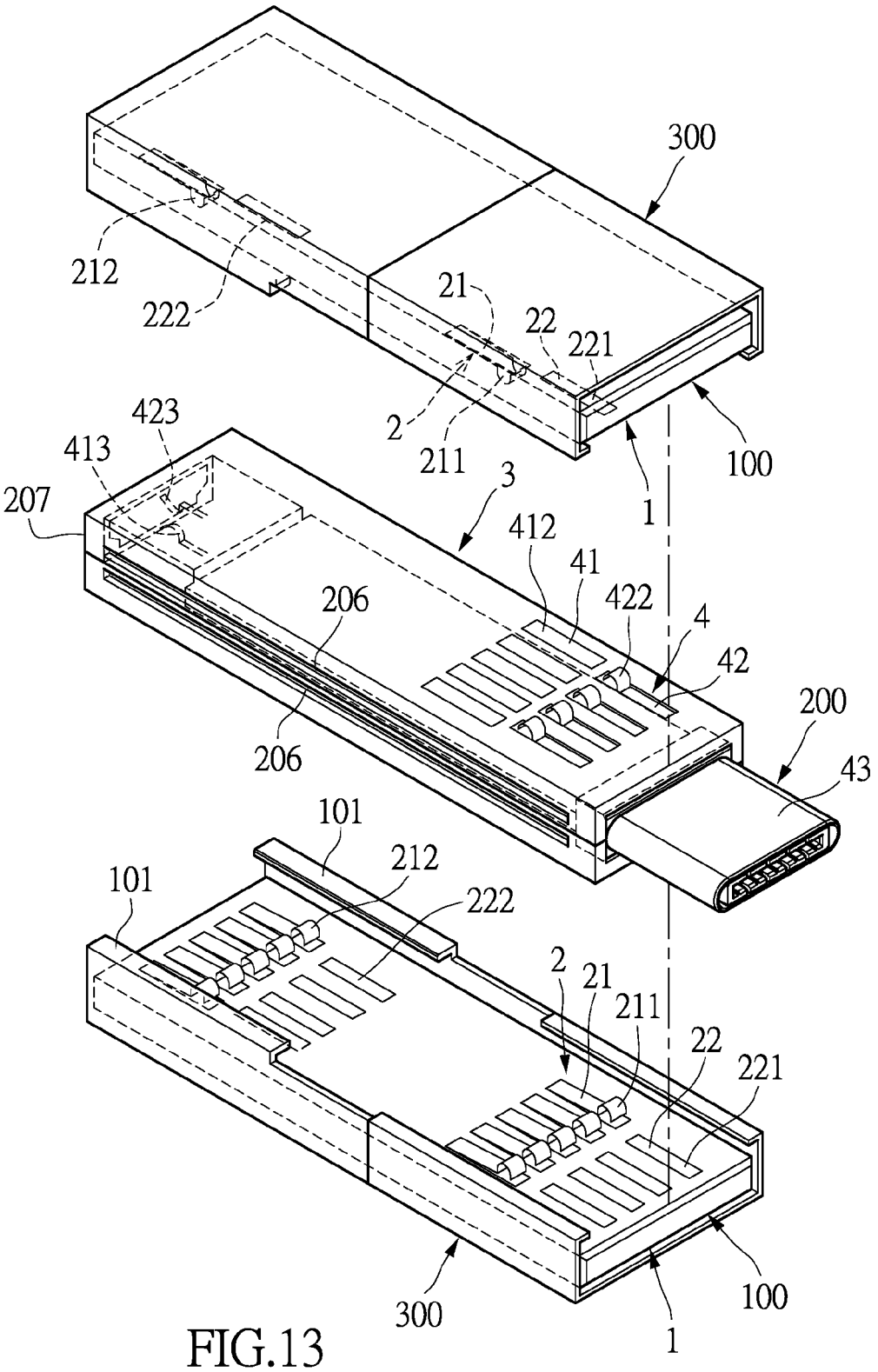
FIG. 13 illustrates an exploded view of a multifunctional connecting device in accordance with a fifth embodiment of the instant disclosure.

With reference to FIG. 13, in the fifth embodiment, two first modules 100 are forwardly and backwardly movable on the second module 200. In other words, an upward first module 100 is disposed on the top of the second module 200 whereas a downward first module 100 is disposed on the bottom of the second module 200. A guide assembly is disposed between the first module 100 and the second module 200, for instance, two guides 101 are arranged on both sides of the first module 100, and the second module 200 correspondingly forms two guide slots 206 and facilitates the steady movement of the first module 100 and the second module 200.

In the center part of the third terminals 41 and the fourth terminals 42, a third conductive portion 412 and a fourth conductive portion 422 are formed respectively. The third and fourth conductive portion 412, 422 are exposed to the top and bottom side of the second insulating main body 3 respectively, so the first conductive portion 212 and the second conductive portion 222 contact the third conductive portion 412 and the fourth conductive portion 422 respectively, and the fourth terminal set 4 is available to selectively electrically contact the first terminal set 2 of the two first modules 100.

The rear end of the third and fourth terminals 41, 42 is formed with a first and second connecting portion 413, 423 respectively. In the fifth embodiment, the rear end of the second module 200 is modified. The first connecting portion 413 of the third terminals 41 and the second connecting portion 423 of the fourth terminals 42 are formed in a contacting structure, so the rear end of the second module 200 is formed into a plug 207, available to connect to a corresponding electronic device.

Figure 14:
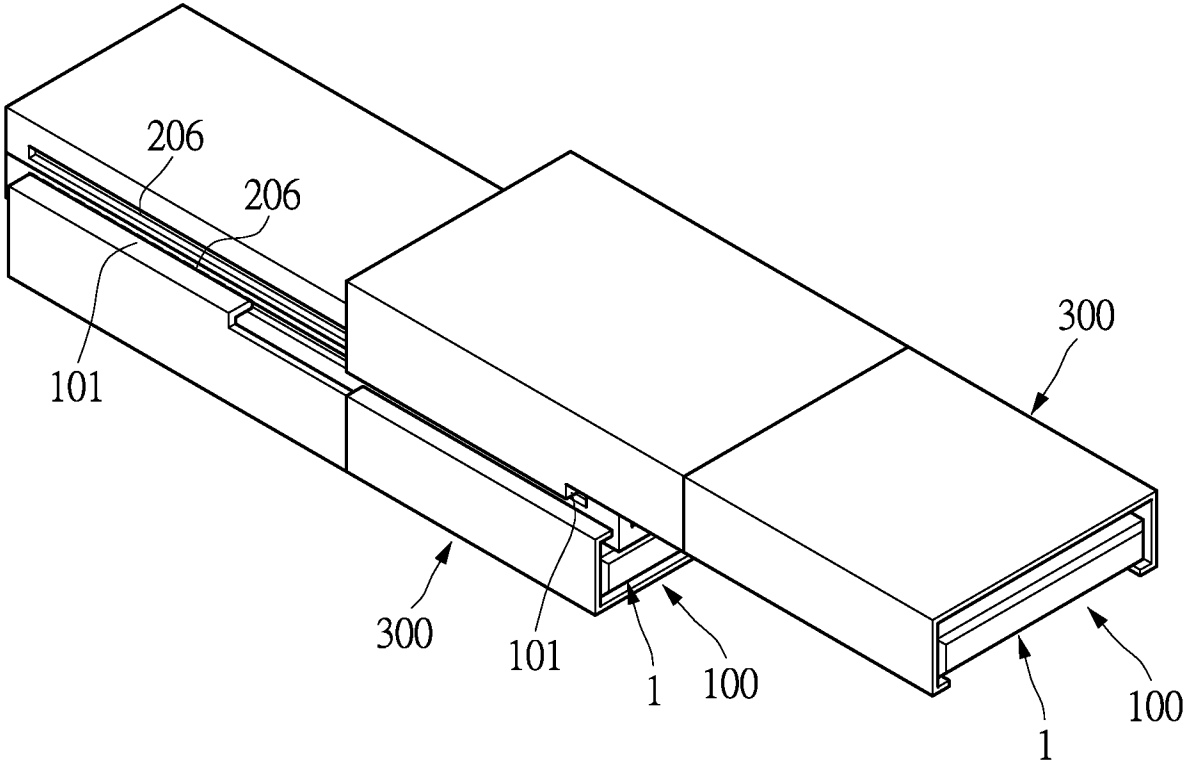
FIG. 14 illustrates a perspective view of a multifunctional connecting device in accordance with a fifth embodiment of the instant disclosure.

When the upward first module 100 (disposed on the top side of the second module 200) moves forward toward the first position (as shown in FIG. 14), the first module 100 launches to the use stage, the third and fourth conductive portion 412, 422 arranged on the top side of the second insulating main body 3 contact the corresponding first and second conductive portion 212, 222 of the upward first module 100, so the first terminal set 2 of the upward first module 100 electrically connects to the second terminal set 4 of the second module 200, as the result, the upward first module 100 launches to use stage, and the first contact portion 211 and the second contact portion 221 of the upward first module 100 are available to electrically connect to the corresponding electronic device.

Figure 15:
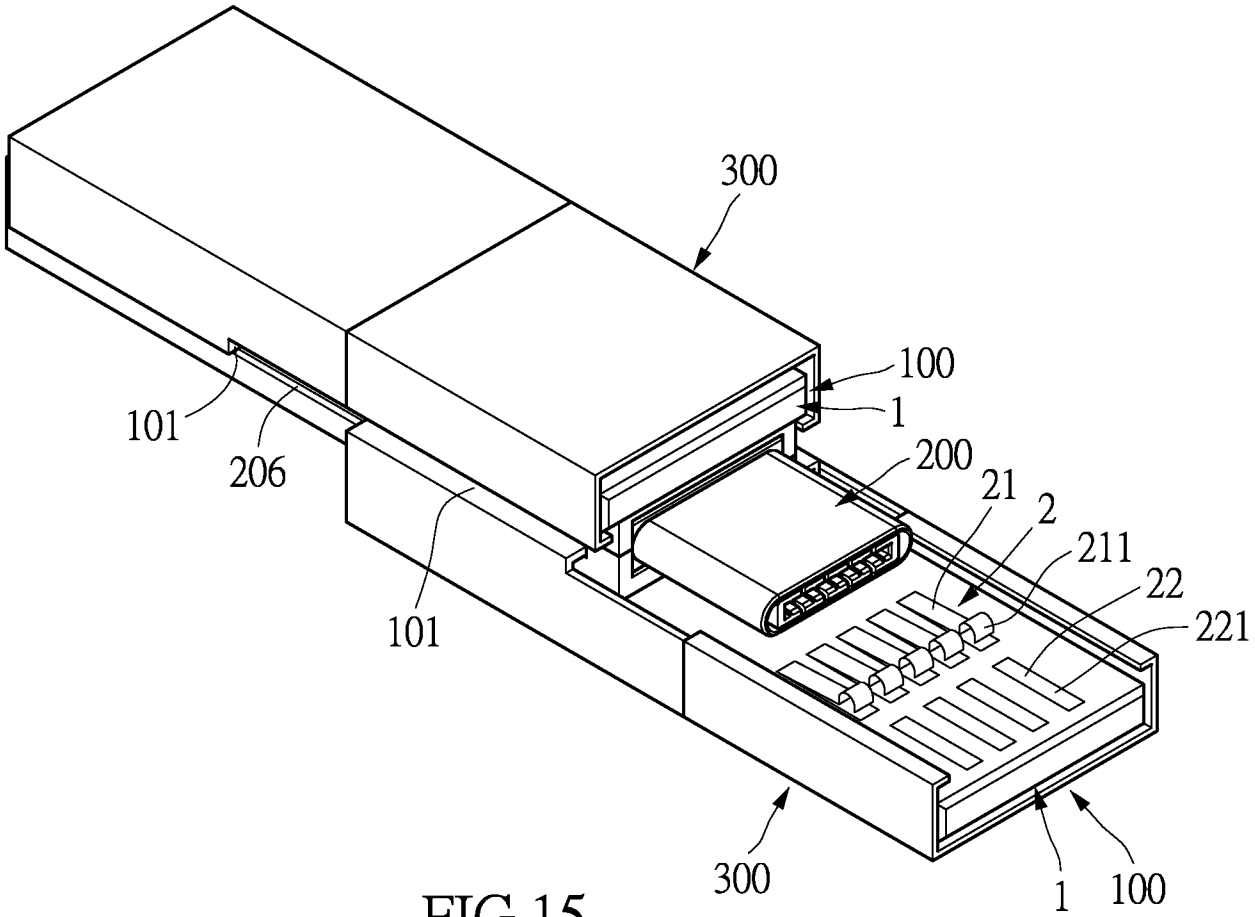
FIG. 15 illustrates a schematic diagram of a multifunctional connecting device in accordance with a fifth embodiment of the instant disclosure.

When the downward first module 100 (disposed on the bottom side of the second module 200) moves forward toward the first position (as shown in FIG. 15), the downward first module 100 launches to use stage, and the third and fourth conductive portion 412, 422 arranged on the bottom side of the second insulating main body 3 contact the corresponding first and second conductive portion 212, 222 of the downward first module 100, so the first terminal set 2 of the downward first module 100 electrically connects to the second terminal set 4 of the second module 200. As the result, the downward first module 100 launches to a use stage, and the first and the second contact portion 211, 221 of the downward first module 100 are available to electrically connect to the corresponding electronic device.

Figure 16:
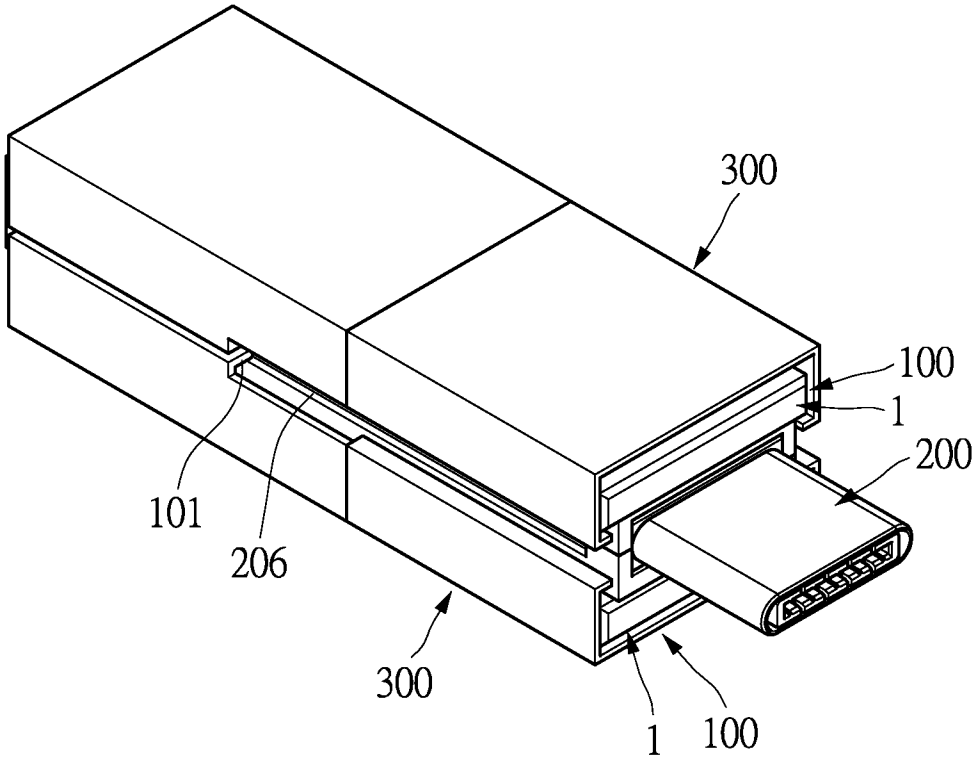
FIG. 16 illustrates another schematic diagram of a multifunctional connecting device in accordance with a fifth embodiment of the instant disclosure.

When the upward first module 100 and the downward first module 100 move backward toward the second module (as shown in FIG. 16), the two first modules 100 launch to a retracted stage and the second module 200 launches to use stage, hence the third and fourth contact portion 411, 421 are available to electrically connect to the corresponding electronic device. In short, by adjusting the linear position of the first module 100 and the second module 200, the multifunctional connecting device is retractable and available to switch to the first module 100 and the second module 200 for two different operations.

Sixth Embodiment

Figure 17:
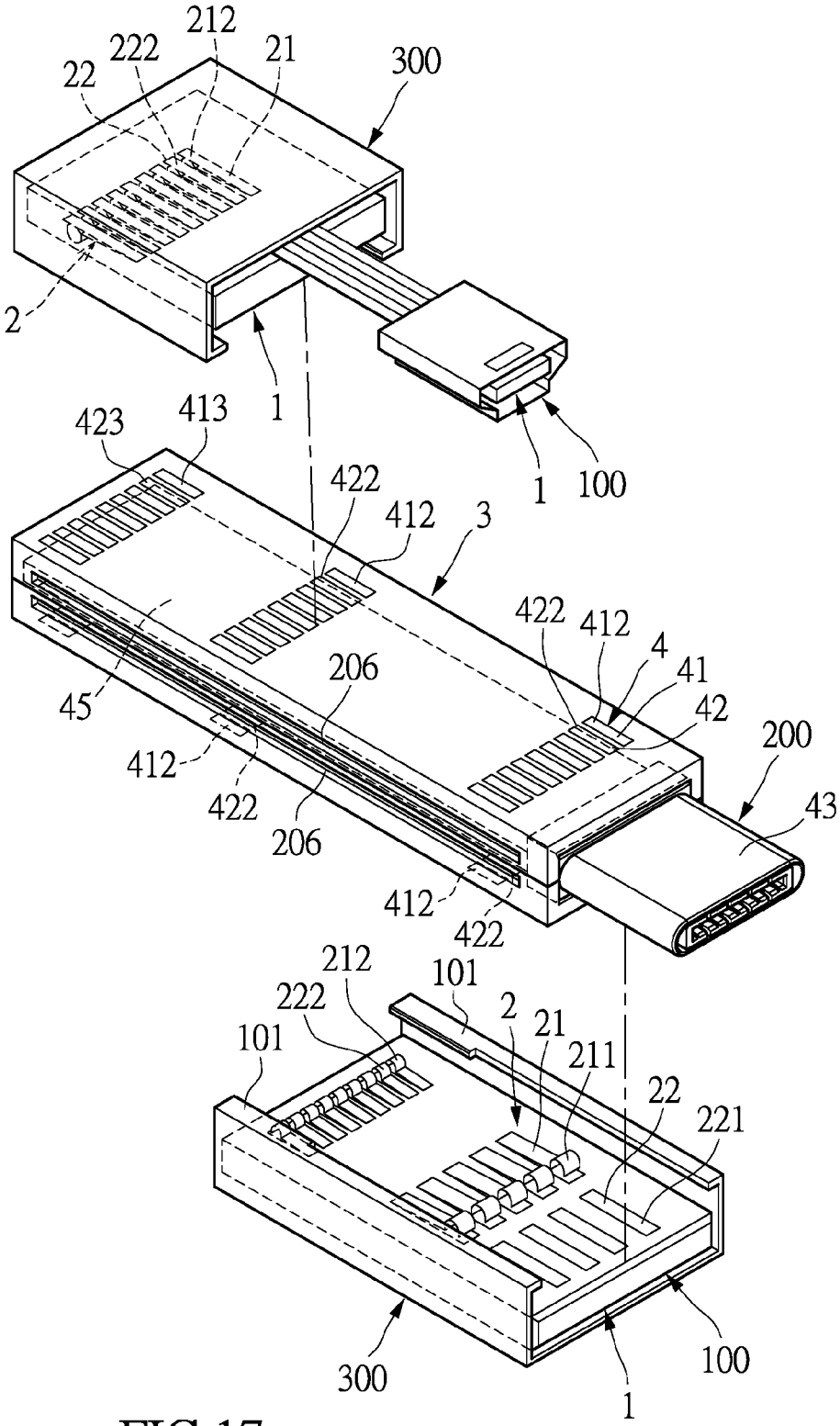
FIG. 17 illustrates an exploded view of a multifunctional connecting device in accordance with a sixth embodiment of the instant disclosure.

With reference to FIG. 17, in the sixth embodiment, two first modules 100 are forwardly and backwardly moveable on the second modules 200, that is, both first modules 100 are arranged on the top and bottom side of the second module 200 respectively. In this embodiment, the upward first module 100 is adapted for Micro USB or Mini USB standards for instance, by adjusting the linear position of the first module 100 and the second module 200, the multifunctional connecting device is retractable and available to switch to the first module 100 and the second module 200 for two different modes. In addition, the two first modules 100 move toward certain directions as required. In this embodiment, the first terminals 21 and the second terminals 22 of the upward and downward first module 100 are formed with the first and second conductive portion 212, 222, respectively. The first and second conductive portion 212, 222 are exposed to one side of the first insulating main body 1 and arranged in one row. A third and fourth conductive portion 412, 422 are formed on the third and fourth terminals 41, 42 respectively. The third and fourth conductive portion 412, 422 are exposed to both sides of the second insulating main body 3 or the circuit board 45 respectively, and arranged in two or multiple rows. The tail of the third and fourth terminals 41, 42 is formed with a first and second connecting portion 413, 423, respectively, and the first and second connecting portion 413, 423 are exposed to one or both sides of the second insulating main body 3 or circuit board 45 respectively. The upward first module 100 and the downward first module 100 are available to move freely so the third and fourth conductive portion 412, 422 selectively contact the corresponding first and second conductive portion 212, 222 of the upward or downward first module 100. When the first module 100 moves forwardly or backwardly toward a different position, the first terminal set 2 electrically contacts the second terminal set 4 thereto.

Seventh Embodiment

Figure 18:
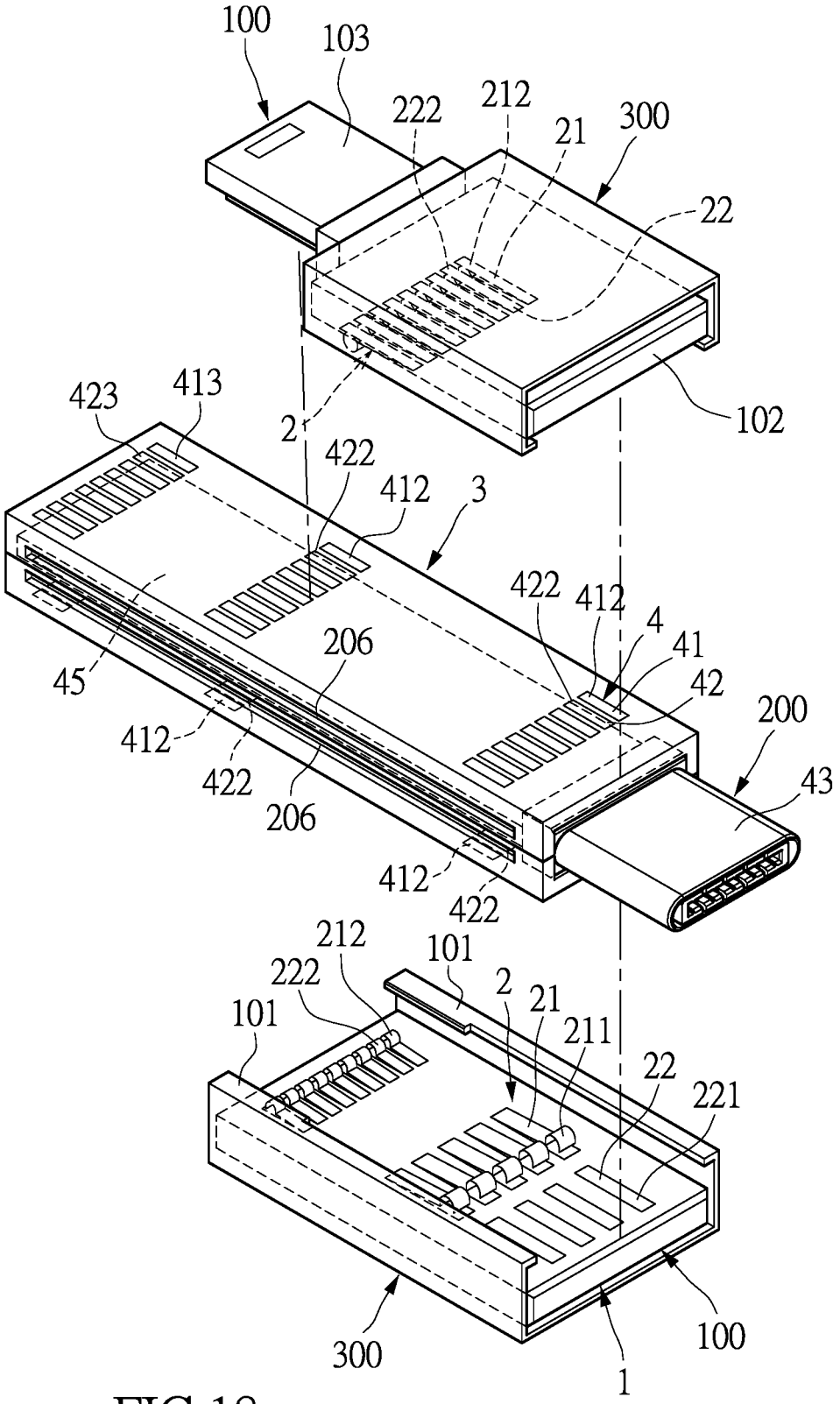
FIG. 18 illustrates an exploded view of a multifunctional connecting device in accordance with a seventh embodiment of the instant disclosure.

With reference to FIG. 18, in the seventh embodiment, two first modules 100 are forwardly and backwardly moveable on the second modules 200, that is, both first modules 100 are movably and detachably arranged on the top and bottom side of the second module 200 respectively. In this embodiment, the upward first module 100 is divided into a first front section 102 and a first rear section 103, the first front section 102 and the first rear section 103 are oriented toward opposite directions for selectively and slidably connecting to different connector interfaces. The first front section 102 is adapted for USB Type-A standards for instance, and the first rear section 103 is adapted for Micro USB or Mini USB standards for instance. By adjusting the linear position of the upward first module 100, the upward first module 100 can be moved to the first position (the front end) or the second position (the back end) for connecting to either the USB Type-A connector interface or the Micro USB connector interface. In other words, when the upward first module 100 moves toward the first position, the first module 100 launches to a use stage to conform to a first connector interface. On the contrary, when the upward first module 100 moves toward the second position, the upward first module 100 launches to a retracted stage to conform to a second connector interface and the second module 200 launches to a use stage to conform to a third connector interface.

Eighth Embodiment

Figure 19:
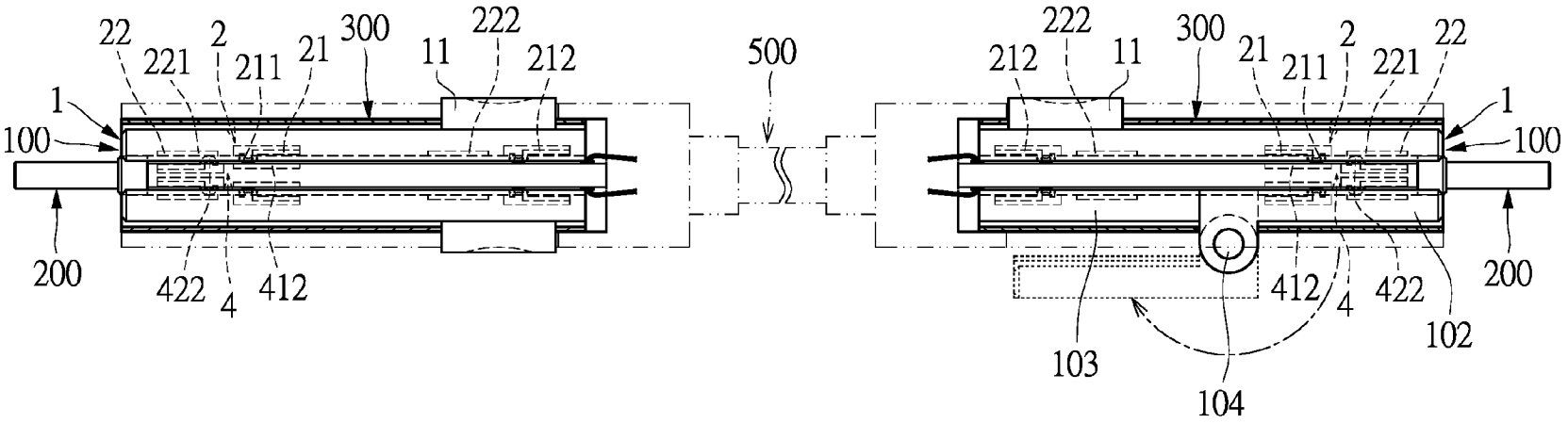
FIG. 19 illustrates the edge view of a multifunctional connecting device in accordance with an eighth embodiment of the instant disclosure.

With reference to FIG. 19, in the eighth embodiment, two first modules 100 are provided and forwardly or backwardly moveable on the second module 200. In other words, two first module 100 move forward and backward on the top or bottom side of the second module 200 respectively. The two first modules 100 electrically contact to each other by cable 500 (for instance). By adjusting the linear position of the first module 100 and the second module 200, the multifunctional connecting device is retractable and available to switch to the first module 100 and the second module 200 for two different modes. The first module 100 is adapted for USB Type-A, USB Type-B, USB Type-C, Micro USB, Mini USB and iPhone connector standard. The first module 100 can be split into two parts, a first front section 102 and a first rear section 103. The first front section 102 is pivoted on the first rear section 102 by a first shaft assembly 104, so the first module 100 is available to rotate.

Ninth Embodiment

Figure 20:
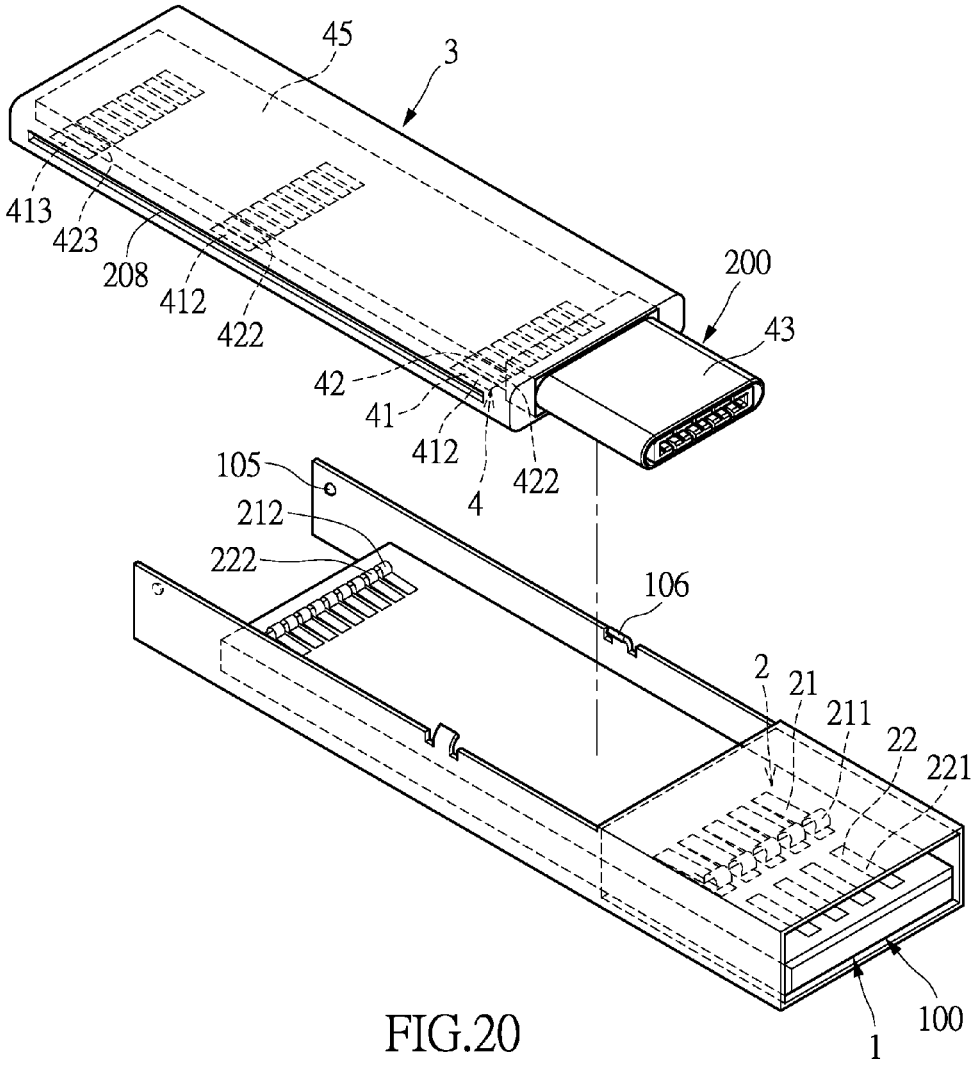
FIG. 20 illustrates an exploded view of a multifunctional connecting device in accordance with a ninth embodiment of the instant disclosure.
Figure 21:
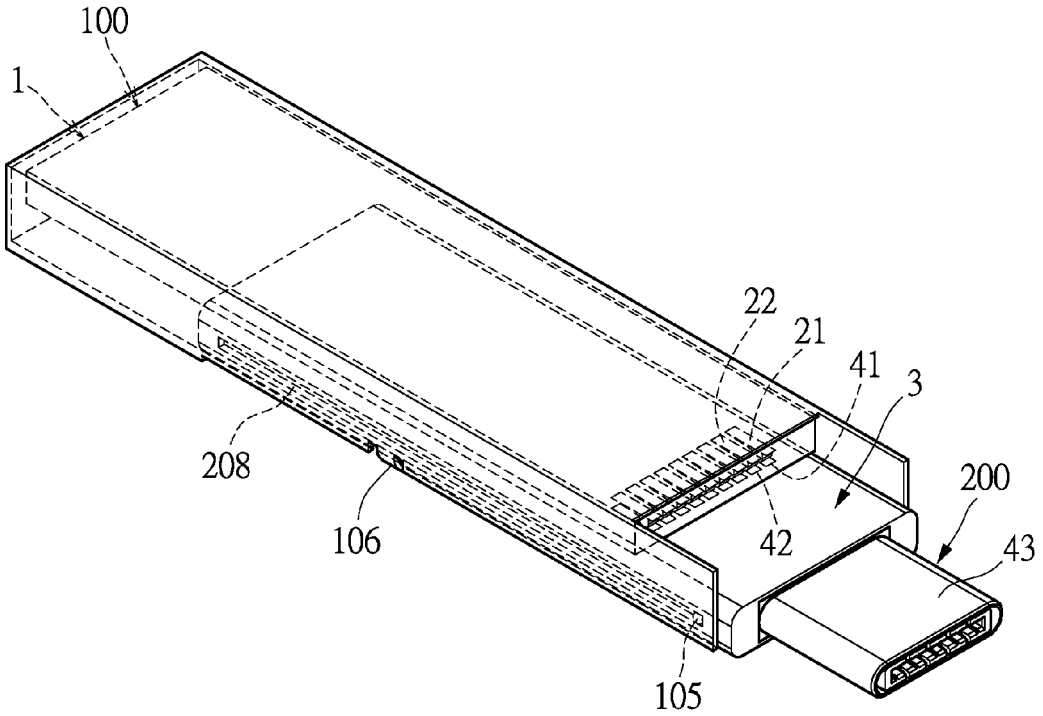
FIG. 21 illustrates a schematic diagram of a multifunctional connecting device in accordance with a ninth embodiment of the instant disclosure.

With reference to FIGS. 20& 21, in the ninth embodiment, the first module 100 is forwardly and backwardly movable on the second module 200, by adjusting the linear position of the first module 100 and the second module 200, the multifunctional connecting device is retractable and available to switch to the first module 100 and the second module 200 for two different modes. In the ninth embodiment, the first and second terminals 21, 22 of the first module 100 are formed with a first and a second conductive portion 212, 222, respectively. The first and second conductive portion 212 222 are exposed to one side of the first insulating main body 1 and aligned in one row. The third and fourth terminals 41, 42 are formed with the third and fourth conductive portions 412, 422 respectively, the third and fourth conductive portions 412, 422 are exposed to one side of the second insulating main body 3 or circuit board 45 and aligned in two or multiple rows. The rear ends of the third and fourth terminals 41, 42 are formed with the first and second connecting portion 413, 423 respectively. The first and second connecting portions 413, 423 are exposed to one side of the second insulating main body 3 or the circuit board 45. The first module 100 is available to move freely so the third and fourth conductive portion 412, 422 selectively contact the first and second conductive portion 212, 222 respectively. When the first module 100 moves toward the predetermined position, the first terminal set 2 electrically contacts the second terminal set 4 of the second module 200.

Moreover, both sides of the first module 100 are formed with a pivot 105, and both sides of the second module 200 comprise the corresponding guide slot 208, hence the first module 100 is steadily movable along the second module 200 and the first module 100 is available to rotate to different directions as required. When the first module 100 stacks on the second module 200, the second module 200 is secured within the first module 100 by the limit stopper portion 106 formed on both sides of the first module 100.

In detail, the first insulating main body 1 and the second insulating main body 3 can be oriented toward the same direction when the first insulating main body 1 is positioned on the bottom side of the second insulating main body 3. The first insulating main body 1 and the second insulating main body 3 can be oriented toward opposite directions when the first insulating main body 1 is positioned on the top side of the second insulating main body 3, as shown in FIG. 21.

The instant disclosure provides the retractable connector so the first module can move relative to the second module, and the first module and the second module are adapted for different connector requirements.

The instant disclosure further provides a housing, the housing comprises a hole and protrusion, so the second module is available to move forwardly and backwardly and secured within the first module by the protrusion and the second module is capable to electrically contact to the first module.

The instant disclosure further provides a second module which is capable to flip accordingly for the customer to use easily.

The instant disclosure further provides two first modules, two first modules are movable forwardly and backwardly on the top and bottom side of the second module respectively for the customer to use easily.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A multifunctional connecting device for operatively connecting to different connector interfaces, comprising:

two first modules, each of the two first modules including:

a first insulating main body; and a first terminal set disposed in the first insulating main body and having a plurality of first terminals and a plurality of second terminals, each of the first terminals formed with a first contact portion and a first conductive portion, each of the second terminals formed with a second contact portion and a second conductive portion; and a second module including:

a second insulating main body; and a second terminal set disposed in the second insulating main body and having a plurality of third terminals and a plurality of fourth terminals, each of the third terminals formed with a third contact portion, a third conductive portion and a first connecting portion, each of the fourth terminals formed with a fourth contact portion, a fourth conductive portion and a second connecting portion, wherein the two first modules are movably arranged on a top and bottom side of the second module respectively and each of the two first module is configured to move toward two positions, a first position where the third conductive portion and the fourth conductive portion contact with the corresponding first conductive portion and the second conductive portion and as a result the first module is launched to a use stage, and a second position where the third conductive portion and the fourth conductive portion are detached from the corresponding first conductive portion and the second conductive portion and as a result the first module is launched to a retracted stage and the second module is launched to a use stage, and wherein one of the two first modules is divided into a first front section and a first rear section, and the first front section and the first rear section are oriented toward opposite directions for selectively and slidably connecting to different connector interfaces.

2. The multifunctional connecting device according to claim 1, wherein the third conductive portion, the first connecting portion, the fourth conductive portion and the second connecting portion are formed on a circuit board.

3. The multifunctional connecting device according to claim 1, wherein a rear end of the second insulating main body includes a containing seat with a U-shape.

4. The multifunctional connecting device according to claim 1 further formed with a third module for electrically contacting the second terminal set of the second module.

5. The multifunctional connecting device according to claim 1, wherein the first connecting portion of the third terminals and the second connecting portion of the fourth terminals are formed in a contacting structure.

6. The multifunctional connecting device according to claim 1, wherein the first conductive portion and the second conductive portion are exposed to one side of the first insulating main body, and the third conductive portion and the fourth conductive portion are exposed to one side of the second insulating main body.

7. A multifunctional connecting device for operatively connecting to different connector interfaces, comprising:

two first modules, each of the two first modules including:

a first insulating main body; and a first terminal set disposed in the first insulating main body and having a plurality of first terminals and a plurality of second terminals, each of the first terminals formed with a first contact portion and a first conductive portion, each of the second terminals formed with a second contact portion and second conductive portion; and a second module including:

a second insulating main body; and a second terminal set disposed in the second insulating main body and having a plurality of third terminals and a plurality of fourth terminals, each of the third terminals formed with a third contact portion, a third conductive portion and a first connecting portion, each of the fourth terminals formed with a fourth contact portion, a fourth conductive portion and a second connecting portion, wherein the two first modules are movably arranged on a top and bottom side of the second module respectively and each of the two first module is configured to move toward two positions, a first position where the third conductive portion and the fourth conductive portion contact the corresponding first conductive portion and the second conductive portion and as a result the first module is launched to a use stage, and a second position where the third conductive portion and the fourth conductive portion detach from the corresponding first conductive portion and the second conductive portion and as a result the first module is launched to a retracted stage and the second module is launched to a use stage;

a housing enveloping an exterior of one or both of the first modules.

8. The multifunctional connecting device according to claim 7, wherein the third conductive portion, the first connecting portion, the fourth conductive portion and the second connecting portion are formed in a circuit board.

9. The multifunctional connecting device according to claim 7, wherein the third conductive portion and the fourth conductive portion are exposed to the opposite side of the second insulating main body, and as a result the third conductive portion and the fourth conductive portion selectively contact the first conductive portion of the first module and the second conductive portion of the first module.

10. The multifunctional connecting device according to claim 7, wherein the first connecting portion of the third terminals and the second connecting portion of the fourth terminals are formed in a contacting structure.

11. The multifunctional connecting device according to claim 7, wherein the first conductive portion and the second conductive portion are exposed to one side of the first insulating main body, the third conductive portion and the fourth conductive portion are exposed to one side of the second insulating main body.

12. A multifunctional connecting device for operatively connecting to different connector interfaces, comprising:

two first modules, each of the two first modules including:

a first insulating main body; and a first terminal set disposed in the first insulating main body and having a plurality of first terminals and a plurality of second terminals, each of the first terminals formed with a first contact portion and a first conductive portion, each of the second terminals formed with a second contact portion and second conductive portion; and a second module including:

a second insulating main body; and a second terminal set disposed in the second insulating main body and having a plurality of third terminals and a plurality of fourth terminals, each of the third terminals formed with a third contact portion, a third conductive portion and a first connecting portion, each of the fourth terminals formed with a fourth contact portion, a fourth conductive portion and a second connecting portion, wherein the two first modules are movably arranged on a top and bottom side of the second module respectively and each of the two first module is configured to move toward two positions, a first position where the third conductive portion and the fourth conductive portion contact the corresponding first conductive portion and the second conductive portion and as a result the first module is launched to a use stage, and a second position where the third conductive portion and the fourth conductive portion detach from the corresponding first conductive portion and the second conductive portion and as a result the first module is launched to a retracted stage and the second module is launched to a use stage, and wherein one of the two first modules is divided into a first front section and a first rear section, and the first front section is pivoted on the first rear section by a shaft assembly.

13. A multifunctional connecting device meeting a USB Type-C specification, comprising:

a second insulating main body; and a second terminal set disposed in the second insulating main body and having a plurality of third terminals and a plurality of fourth terminals, each of the third terminals formed with a third contact portion, third conductive portion and a first connecting portion, each of the fourth terminals formed with a fourth contact portion, fourth conductive portion, and a second connecting portion, wherein the third conductive portion and the fourth conductive portion are exposed to one side or both sides of the second insulating main body and aligned in multiple rows;

wherein a first insulating main body is formed with pivots and limit stopper portions, and the second insulating main body is correspondingly formed with guide slots, the first insulating main body is configured to move forwardly and backwardly on a top side or a bottom side of the second insulating main body via the pivots engaged with the slots, and to be positioned on the top side or the bottom side of the second insulating main body via the limit stopper portions;

wherein the first insulating main body and the second insulating main body are oriented toward a same direction when the first insulating main body is positioned on the bottom side of the second insulating main body;

wherein the first insulating main body and the second insulating main body are oriented toward opposite directions when the first insulating main body is positioned on the top side of the second insulating main body.

* * * * *